US007287946B2

(12) United States Patent
Bonerb

(10) Patent No.: US 7,287,946 B2
(45) Date of Patent: Oct. 30, 2007

(54) UNLOADER FOR DISCHARGING DRY MATERIALS FROM BULK BAGS

(75) Inventor: Timothy Bonerb, Jackson, NH (US)

(73) Assignee: Shick Tube-Veyor Corp., Kansas City, MO (US)

( * ) Notice: Subject to any disclaimer, the term of this patent is extended or adjusted under 35 U.S.C. 154(b) by 262 days.

(21) Appl. No.: 10/500,057

(22) PCT Filed: Nov. 26, 2002

(86) PCT No.: PCT/US02/38207

§ 371 (c)(1),
(2), (4) Date: Jun. 24, 2004

(87) PCT Pub. No.: WO03/045784

PCT Pub. Date: Jun. 5, 2003

(65) Prior Publication Data

US 2006/0204353 A1 Sep. 14, 2006

(51) Int. Cl.
*B65G 65/04* (2006.01)

(52) U.S. Cl. ..... 414/412; 414/422; 414/403

(58) Field of Classification Search ..... 414/412, 414/403, 422, 423, 424
See application file for complete search history.

(56) References Cited

U.S. PATENT DOCUMENTS 1,520,538 A * 12/1924 Dodge ..... 414/422
2,728,473 A * 12/1955 Pickard et al. ..... 414/422
2,764,973 A * 10/1956 Miller ..... 126/343.5 A
3,447,269 A * 6/1969 Haluch et al. ..... 451/326
3,482,718 A 12/1969 Moriarty ..... 214/305
3,853,235 A * 12/1974 Lambert et al. ..... 414/412
4,348,801 A * 9/1982 Dumont et al. ..... 29/564.3
4,527,716 A 7/1985 Haas et al. ..... 222/83.5
4,790,708 A 12/1988 von Bennigsen-Mackiewicz et al. ..... 414/403
4,966,311 A 10/1990 Taylor ..... 222/105
5,401,134 A 3/1995 Habicht et al. ..... 414/422
5,649,801 A 7/1997 White ..... 414/412
5,947,333 A 9/1999 Hoffmann et al. ..... 222/105
6,499,937 B1 * 12/2002 Madison et al. ..... 414/787
7,063,493 B2 * 6/2006 Pfeiffer et al. ..... 414/412

* cited by examiner

*Primary Examiner*—Joe Dillon, Jr.
(74) *Attorney, Agent, or Firm*—Phillip E. Decker; Mesmer & Deleault, PLLC

(57) ABSTRACT

An unloader for discharging and feeding dry, granular type materials from bulk bags. Among the many improvements of the discharge apparatus is an open frame (20) and offset discharge location. Other improvements include an I-beam (23) and frame design that keeps the hoist (25) movement within the four corner posts of the frame. The unloader may be provided with vibrators, vibration isolators, load cells, actuators (107, 108), massage paddles, or plates (106, 109) to assist in the discharge function.

11 Claims, 10 Drawing Sheets

UNLOADER FOR DISCHARGING DRY MATERIALS FROM BULK BAGS

BACKGROUND

1. Field of Invention

This invention relates to unloaders for discharging dry and semi-dry materials from bulk bags.

2. Description of Related Art

As many processors improve their operations by using bulk bags, instead of handling and manually dumping 50 lbs. and 100 lbs. paper bags, the need for a safer, more compact and flexible frame design of bulk bag unloaders has grown.

One of the more vexing problems in handling bulk bags is the requirement of a tall, four-posted frame with a cantilevered I-Beam that extends outward at the top of the frame so that a bulk bag can be lifted from its pallet on the floor up and onto the discharge apparatus of the unloader frame. The typical unloader frame is generally equipped with several diagonal and horizontal bracing structures between the four vertical, corner posts and hoist apparatus. This extra bracing around the frame makes it difficult to interface other types of feeding, dust collection and discharge equipment close to the discharge spout location of the bulk bag. Other problems and hazards are created when lifting a heavy bulk bag with the extended I-Beam configuration.

SUMMARY

It is the object of the invention to use a smaller footprint for a bulk bag unloader.

Another object of the invention is lift and discharge a bulk bag on a standard sized unloader frame without the use of a cantilevered I-Beam. Another object of the invention is to provide a safer method of lifting a bulk bag for unloading.

Yet another object of the invention is to provide a more open and accessible frame around the bulk bag when it placed on the unloader.

Another object of the invention is to use a pick-up location and discharge location within the area of a four-posted unloader frame.

Another object of the invention is to allow other types of conveying, dust collection and metering devices to be interfaced with the unloader frame closer to the discharge spout of the bulk bag.

Yet another object of the invention is to eliminate the use of secondary bracing structures on the unloading frame.

Another object of the invention is to provide greater flexibility to where the horizontal frames may be located on the four-vertical posts.

DRAWINGS

DESCRIPTION

Figure 1:
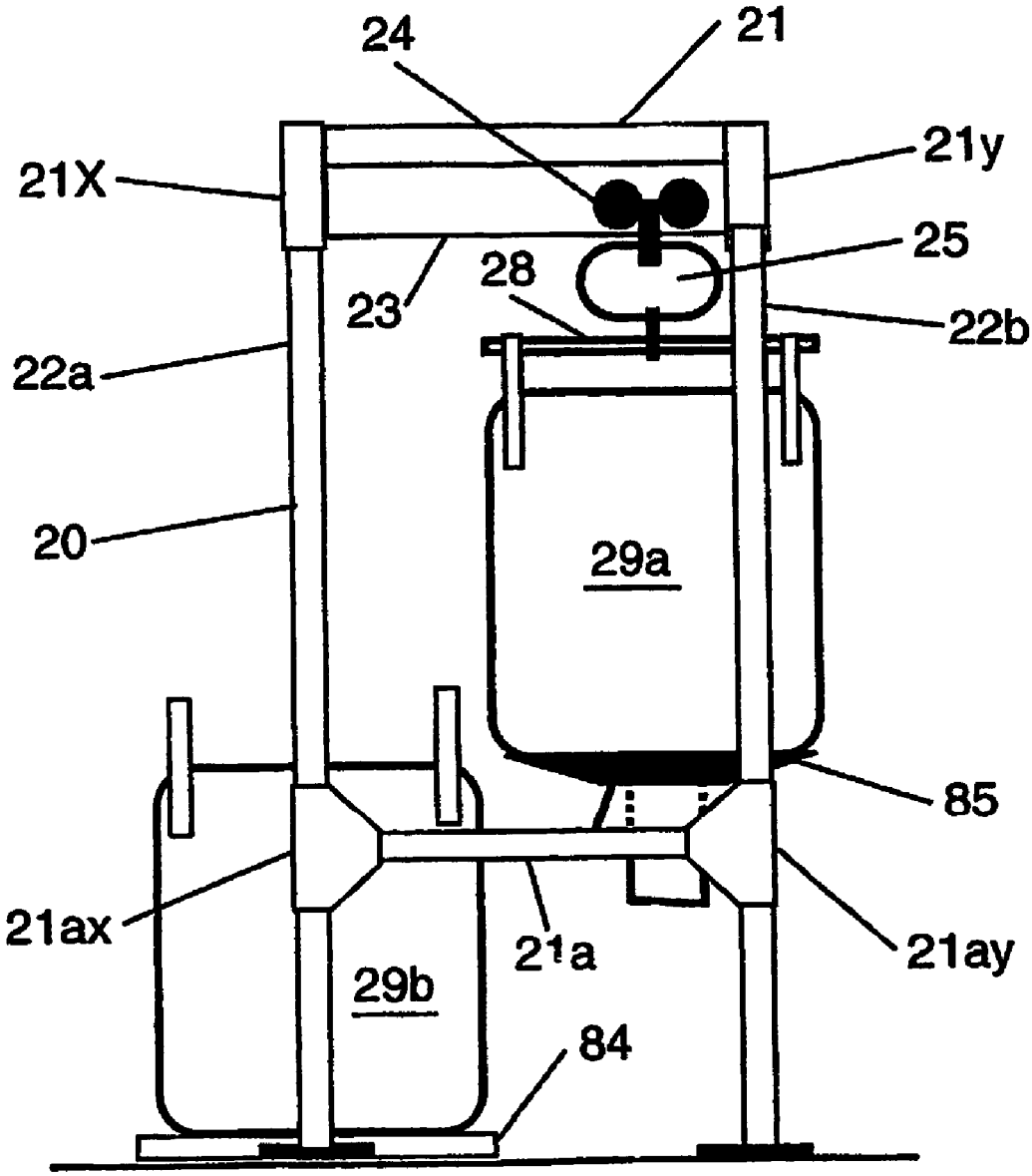
FIG. 1 is a side view of a bulk bag unloader with one bag positioned for discharge while a second bag is staged on the floor waiting to be lifted into position and discharged.

FIG. 1 is a side view of unloader frame 20. Top frame support 21 is equipped with corner brackets 21*x* and 21*y* (21*v* and 21*z* not shown) and bottom frame 21*a* is equipped with corner brackets 21*ax* and 21*ay* (21*av* and 21*az* not shown) to secure corner posts 22*a* and 22*b* (22*c* and 22*d* not shown) in position to form unloader frame 20. Unlike other bulk bag unloaders, I-beam 23 does not extend outside of the perimeter of corner posts 22*a*, 22*b*, 22*c* and 22*d*. I-beam 23 is secured to top frame 21 and allows hoist 25 to move between posts 22*a* and 22*b* via trolley 24. Bag 29*a* is held in position by bag support frame 28 and bag support tray 85. Bag support tray 85 may be located off center within the four corner posts 22*a*, 22*b*, 22*c* and 22*d*. Bag 29*b* is on pallet 84 in a location within the four corner posts 22*a*, 22*b*, 22*c* and 22*d* so that it can be lifted with hoist 25 when moved to the left end of I-beam 23. Corner brackets 21*ay*, 21*ax*, 21*av* and 21*az* of bottom frame 21*a* are designed to provide lateral support and can be located any where along the corner posts 22*a*, 22*b*, 22*c* and 22*d* to allow for the height of bag support tray 85 to be adjustable. Corner brackets 21*x*, 21*v*, 21*y* and 21*z* also add lateral support and rigidity to unloader frame 20 and may also be secured at any elevation.

Figure 2:
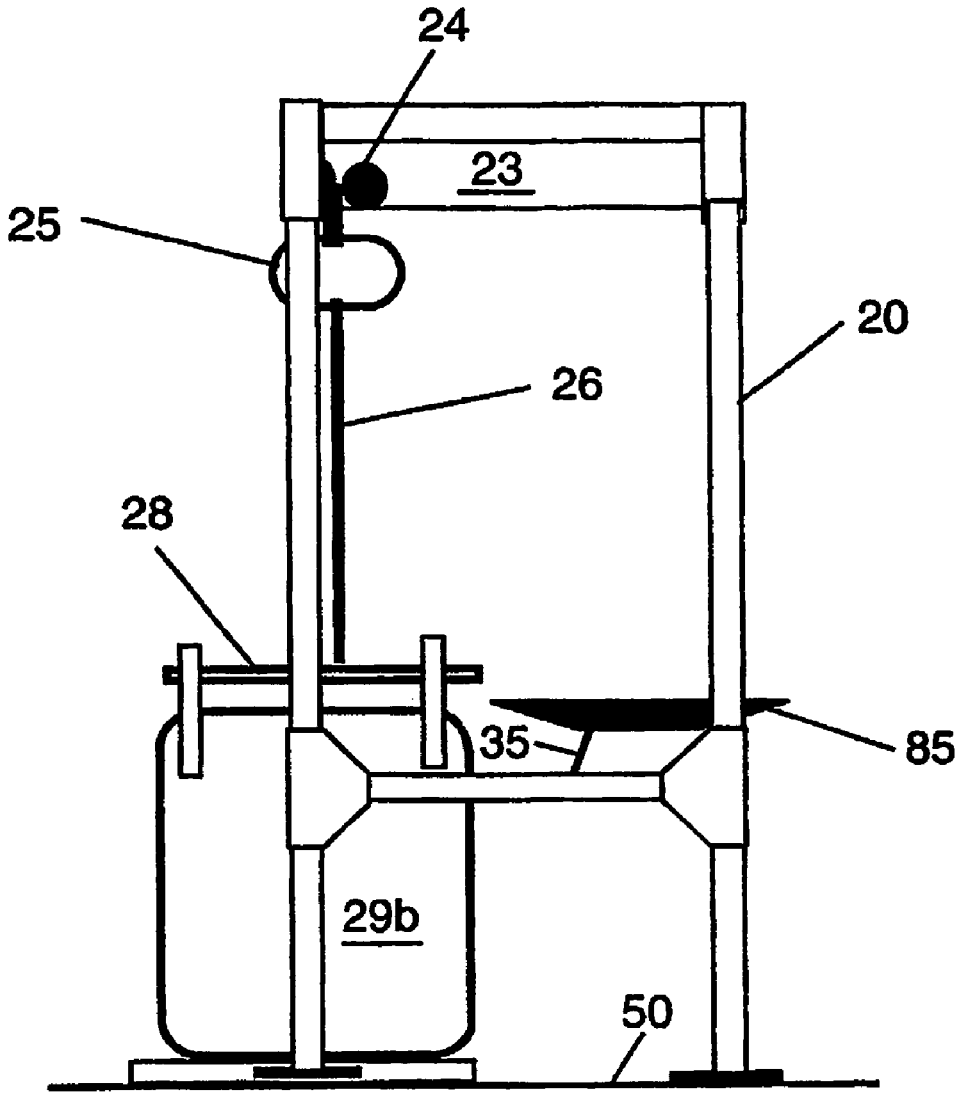
FIG. 2 is a side view of a bulk bag unloader frame with the hoist in position to lift a full bulk bag from its pallet on the floor to the discharge position.

FIG. 2 is a side view of unloader frame 20 with hoist 25 moved along I-beam 23 via trolley 24 to a position over bag 29*b*. Chain 26 and bag frame 28 are lowered for bag to be lifted. Bag 29*b* is staged in the open frame area of unloader 20 on floor 50. Bag support tray 85 is empty, ready for bag 29*b* to be positioned thereon.

Figure 3:
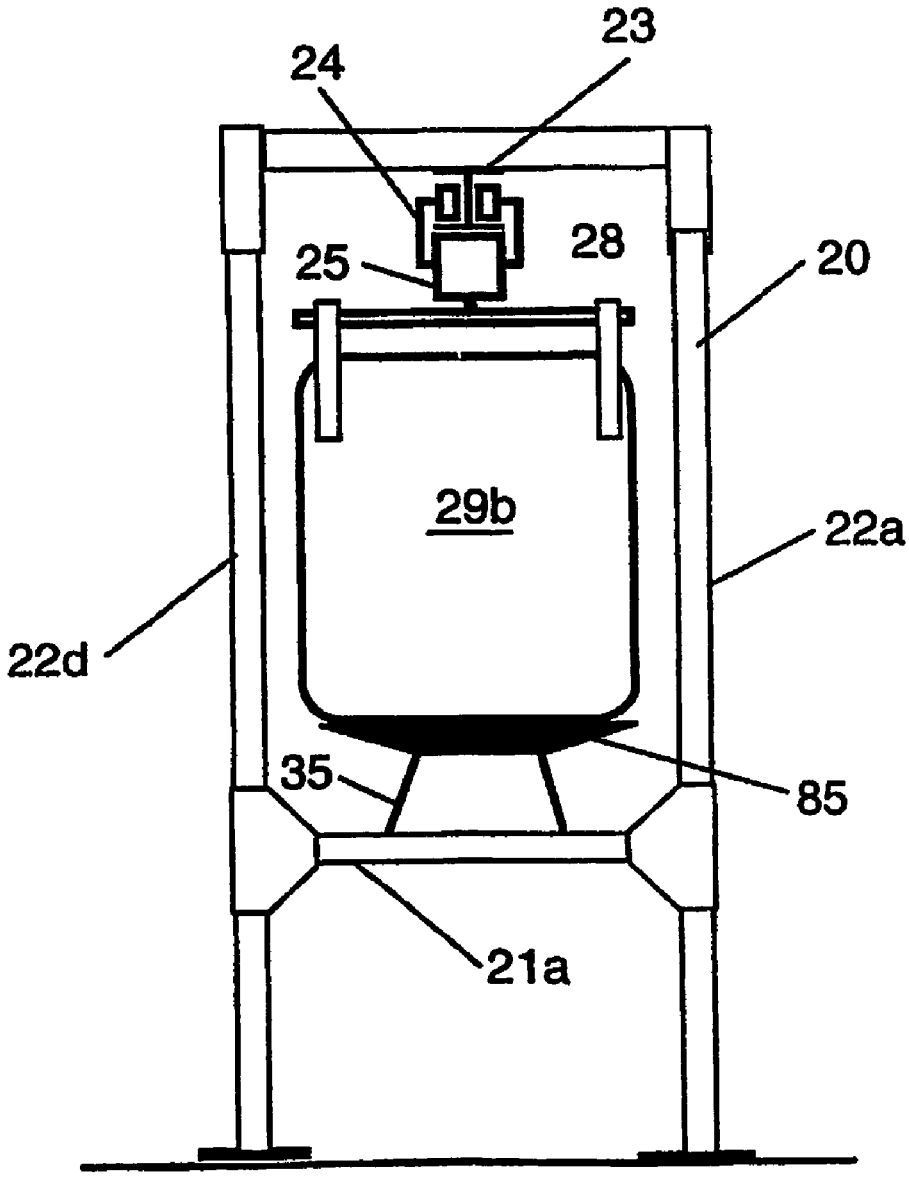
FIG. 3 is a front view of a bulk bag lowered over the base ram and tray support for discharging.

FIG. 3 is a front view of unloader frame 20 with bag 29*b* lowered onto ram base 35 and bag support frame 85. Bottom frame 21*a* does not have a support member located between vertical posts 22*a* and 22*d* to provide an open area directly under I-beam 23, trolley 24 and hoist 25.

Figure 4:
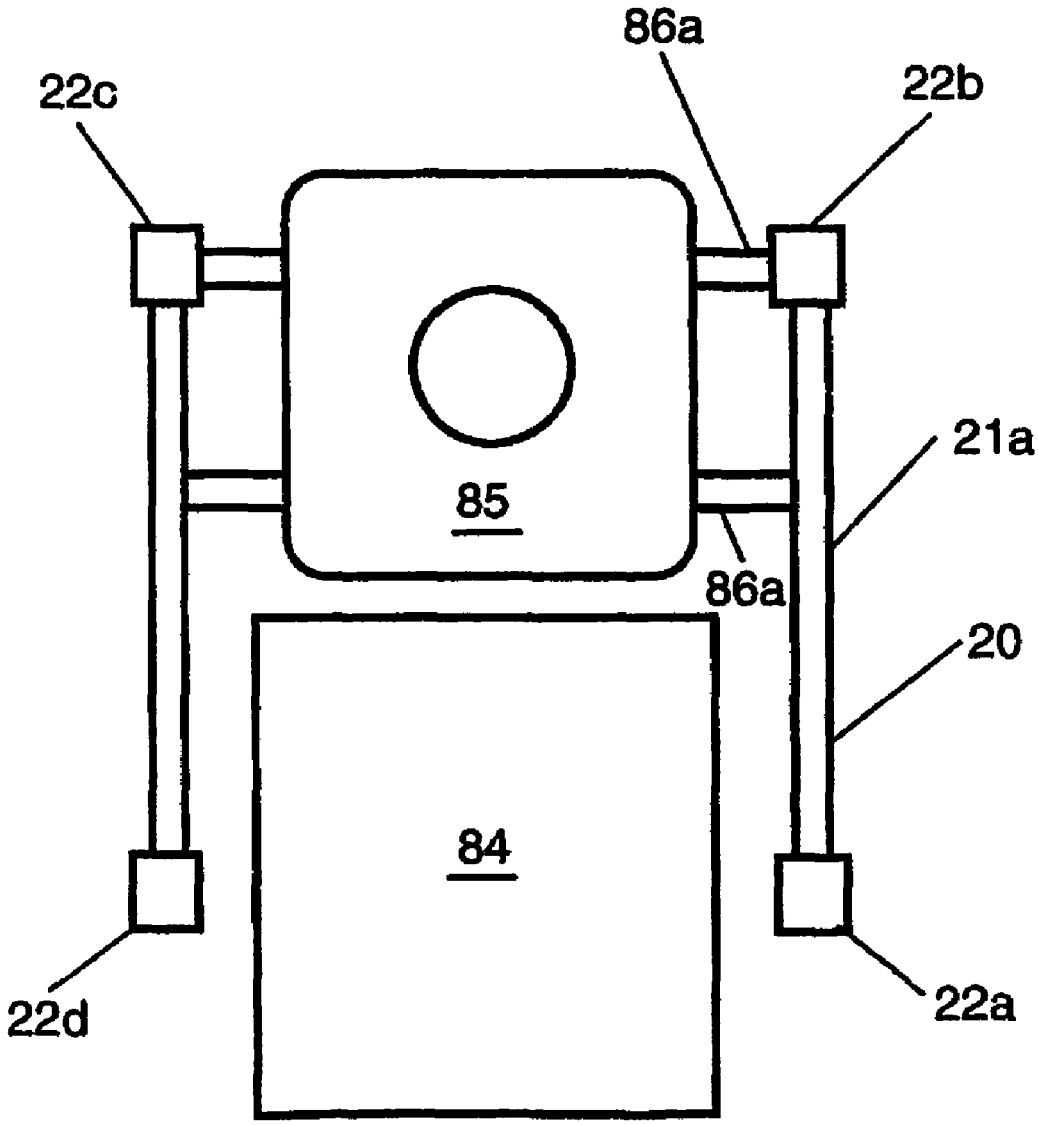
FIG. 4 is a top of a bulk bag unloader with an open side and offset discharge location.

FIG. 4 is a top view of bottom frame 21*a* secured to vertical posts 22*a*, 22*b*, 22*c* and 22*d*. Bag support tray is supported by cross beam supports 86*a* and 86*b*. Pallet 84 is shown on floor in an open area of unloader frame 20. Because a cross support brace is not used between vertical posts 22*a* and 22*d* of bottom frame 21*a* and the bag support tray 85 is located off center of unloader frame 20, the I-Beam and Hoist Assembly (not shown) do not have to extend beyond vertical posts 22*a*, 22*b*, 22*c* and 22*d*.

Figure 5:
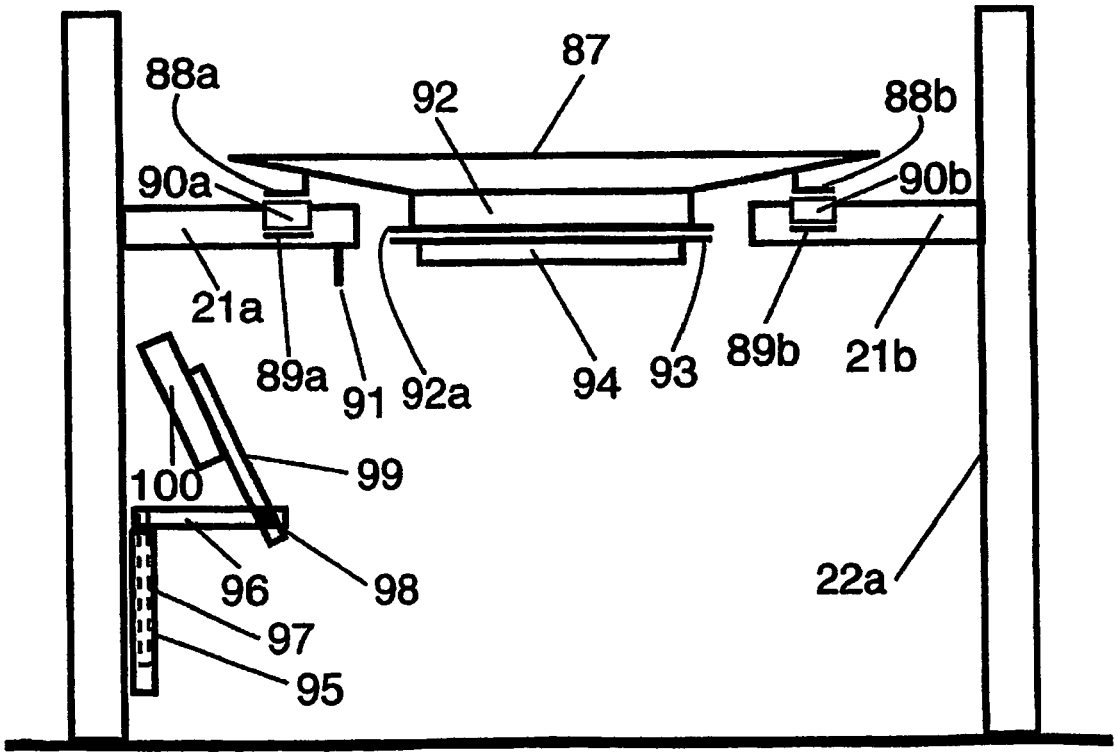
FIG. 5 is a side view of a bulk bag unloader showing details of the bag support means.

FIG. 5 is an end view of the lower section of the unloader with seat housing 95 secured to vertical support post 22*a*. Axle 97 of seat frame 96 is placed inside seat housing 95 to allow seat frame 96 to swivel off support post 22*a*. Seat extension support 99, with seat 100 attached, is mounted to seat frame 96 at pivot joint 98. Seat 100 may be mounted in a stationary position or in a swivel and foldable configuration as shown, to assist operator with the set up and discharge of a bulk bag on the unloader. It is understood that any configuration of the unloader may be provided with a seat 100, and not just the configuration shown in FIG. 5.

To provide the unloader with a variety of discharge options to handle different sized bags and/or materials with varying flow characteristics, bag support hopper 87 is equipped with hopper brackets 88*a* and 88*b* (88*c* and 88*d* not shown) that may be supported by unloader frame brackets 89*a* and 89*b* (89*c* and 89*d* not shown) on horizontal support frames 21*a* and 21*b* (21*c* and 21*d* not shown). Bag support hopper 87 may be provided as a rectangular or conical shape with various slope angles. Spacers 90*a* and 90*b* (90*c* and 90*d* not shown) are positioned between hopper brackets 88*a* and 88*b* (88*c* and 88*d* not shown) and unloader frame brackets 89*a* and 89*b* (89*c* and 89*d* not shown). Spacers 90*a* and 90*b* (90*c* and 90*d* not shown) may be interchanged with vibration isolators, load cells or other discharge devices as the configuration dictates. It is intended that the vibration isolators, load cells, and other discharge devices fit in the same space as the spacers as shown in FIG. 5 to facilitate manufacture and/or reconfiguration of the unloader. Spacers 90 may be supplied in one or more units as required to support bag support hopper 87. If vibration is desired to assist in breaking up settled material inside the bulk bag, a vibrator may be secured to vibration flange 91 and vibration isolators used instead of spacers 90. Hopper flange ring 92 on bag support hopper 87 is equipped with accessory mounting flange 92*a*. Discharge device 94, such as iris valve which is attached discharge device plate 93 may be fastened together using bolts, welds or with a V-band type clamp. Discharge device 94 may include valves, surge hoppers, filters, conveyors and the like.

Figure 6:
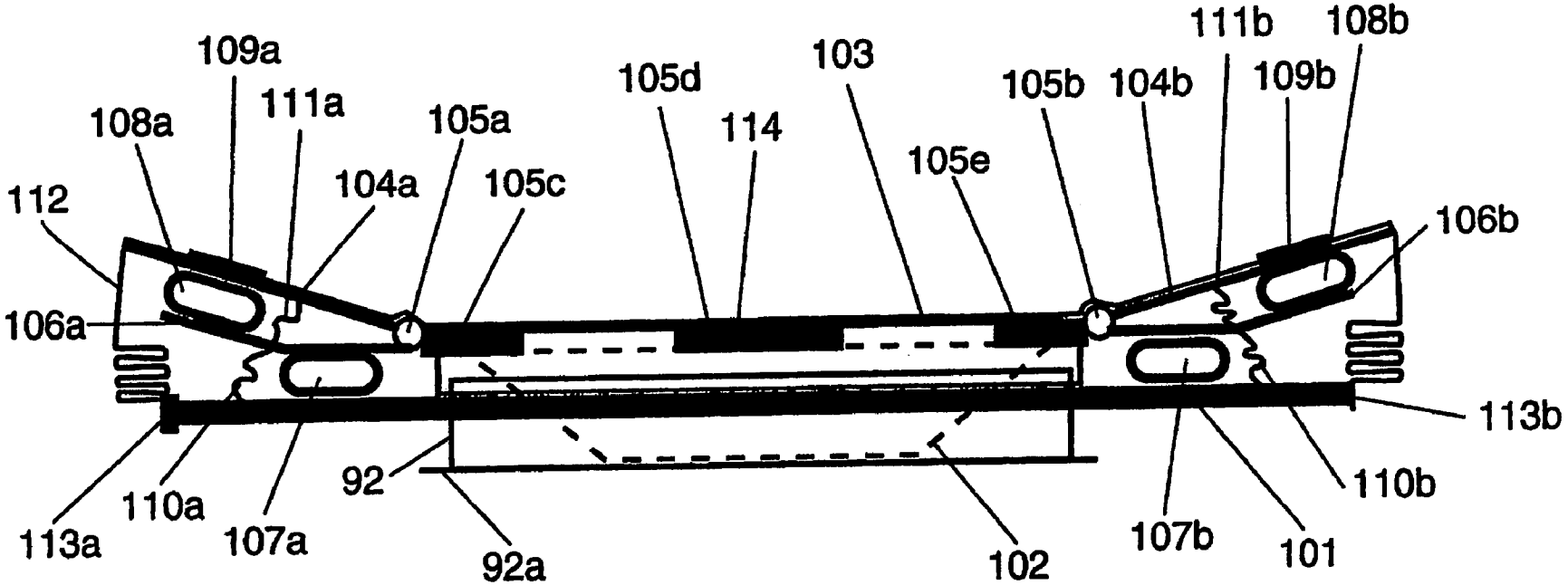
FIG. 6 is a side view of an unloader bag support hopper having massage paddles.

FIG. 6 is a side view a bag support hopper with mounting base 101 that may be secured to unloader frame brackets 89*a*, 89*b*, 89*c* and 89*d* (not shown) of unloader 20 (not shown.) To provide agitation to materials shipped in bulk bags, unloaders are often equipped with plunger devices and stretching mechanisms to empty bulk bags. These devices often require several feet of elevation space for mounting and operation. Mounting base 101 is equipped with pivoting massage paddles 104*a* and 104*b* to form a platform for bulk bags to be placed upon for unloading. When lower group of bottom actuators 107*a* and 107*b*; and upper group of top actuators 108*a* and 108*b* are deflated and at rest, massage paddles 104*a* and 104*b* form a shallow hopper surface of approximately 15 degrees with an elevation height of only about 30 cm (12 inches). Hopper flange ring 92 is attached to mounting 101 and may use an internal hopper ring 102 inside to direct the flow of material from a bulk bag (not shown) through a smaller valve or outlet opening of accessory mounting flange 92*a*. Internal hopper ring 102 may have a vibrator (not shown) secured to it to help promote the flow of material from a bag. Top hinge ring plate 103 is secured to hopper flange ring 92 and mounting base 101 to provide support for hinges 105*a*, 105*c*, 105*d*, 105*e* and 105*b*. Massage paddle assemblies that attached to hinges 105*c*, 105*d* and 105*e* are not shown. Sandwiched between the top actuators 108*a* and 108*b* and bottom actuators 107*a* and 107*b* are hinge plates 106*a* and 106*b* respectively. Massage paddles 104*a* and 104*b*; and hinges plates 106*a* and 106*b* incline and pivot inward using hinges 105*a* and 105*b* when bottom actuators 107*a* and 107*b* and or 108*a* and 108*b* are inflated with compressed air. As bottom actuators 107*a* and 107*b* and/or top actuators 108*a* and 108*b* are inflated, the angle of massage paddles 104*a* and 104*b* is increased to help dispense material in bag.

Bottom restraints 110*a* and 110*b* are secured to mounting base 101 and hinge plates 106*a* and 106*b* to limit movement of actuators 107*a* and 107*b*. Actuators 107*a*, 107*b*, 108*a* and 108*b* may rupture or become damaged if their movement is not limited by some type of mechanical linkage or stopping device. Bottom and top restraints 110*a*, 110*b*, 111*a* and 111*b* may be made of cable, chain or other types of linkage components. To provide a protective guard over and around the moving parts of adjustable bag hopper 114 assembly, including massage paddles 104*a* and 104*b*, hinge plates 106*a* and 106*b* and actuators 107*a*, 107*b*, 108*a* and 108*b*, flexible cover 112 is secured to the perimeter of mounting frame 101 at side joints 113*a* and 113*b* and over massage paddles 104*a* and 104*b* via top plates 109*a* and 109*b*.

Figure 7:
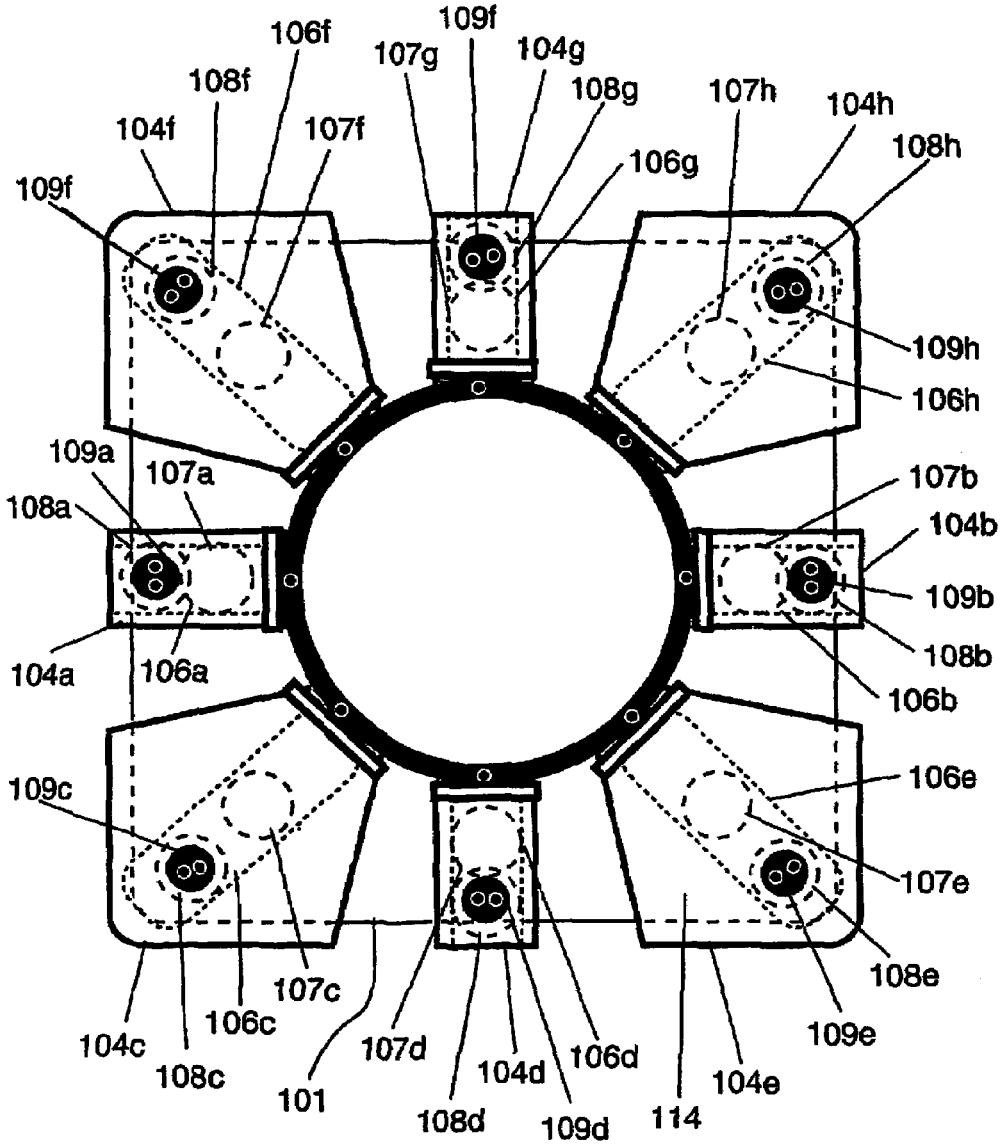
FIG. 7 is a top view of the hopper of FIG. 6.

FIG. 7 is a top view of adjustable bag hopper 114 with base mounting frame 101 having top hinge ring plate 103 with hinges 105*a*, 105*b*, 105*c*, 105*d*, 105*e*, 105*f*, 105*g* and 105*h* secured to it. Massage paddles 104*a*, 104*b*, 104*c*, 104*d*, 104*e*, 104*f*, 104*g* and 104*h*; and hinge plates 106*a*, 106*b*, 106*c*, 106*d*, 106*e*, 106*f*, 106*g* and 106*h* are secured to hinges 105*a*, 105*b*, 105*c*, 105*d*, 105*e*, 105*f*, 105*g* and 105*h* respectively.

To move the top surface of massage paddles 104*a*, 104*b*, 104*c*, 104*d*, 104*e*, 104*f*, 104*g* and 104*h* from an angle of approximately 15 to 30 degrees to a maximum angle of approximately 70 to 85 degrees to help agitate and empty the contents of a bulk bag (not shown), bottom actuators 107*a*, 107*b*, 107*c*, 107*d*, 107*e*, 107*f*, 107*g* and 107*h* are secured to mounting base 101 and hinge plates 106*a*, 106*b*, 106*c*, 106*d*, 106*e*, 106*f*, 106*g* and 106*h* together with top actuators 108*a*, 108*b*, 108*c*, 108*d*, 108*e*, 108*f*, 108*g*, and 108*h* secured to hinge plates 106*a*, 106*b*, 106*c*, 106*d*, 106*e*, 106*f*, 106*g* and 106*h* to massage paddles 104*a*, 104*b*, 104*c*, 104*d*, 104*e*, 104*f*, 104*g* and 104*h* respectively. Massage liner plates 109*a*, 109*b*, 109*c*, 109*d*, 109*f*, 109*g* and 109*h* may be used to hold flexible cover 112 massage paddles 104*a*, 104*b*, 104*c*, 104*d*, 104*e*, 104*f*, 104*g* and 104*h* respectively if flexible cover 112 (not shown) is used with adjustable bag hopper 114. Cover ring 115 (not shown) is placed on top of flexible cover 112 and top hinge ring plate 103 around opening 116 to hold the edge of flexible cover 112 in place. Because many bulk bags are rectangular in shape and therefore materials does not always empty out of its corners even when stretched or otherwise massaged, corner massage paddles 104*c*, 104*e*, 104*h* and 104*f* are very effective in emptying bulk bag because they incline to a steep angle of about 80 to 90 degrees and push directly against the corners of a bag. In addition to corner massage paddles 104*c*, 104*e*, 104*h* and 104*f*, side massage paddles 104*d*, 104*b*, 104*g* and 104*a* also incline to an angle of about 80 to 90 degrees to form a very steep sided hopper, capable of discharging almost all types of materials that are handled in bulk bags.

Figure 8:
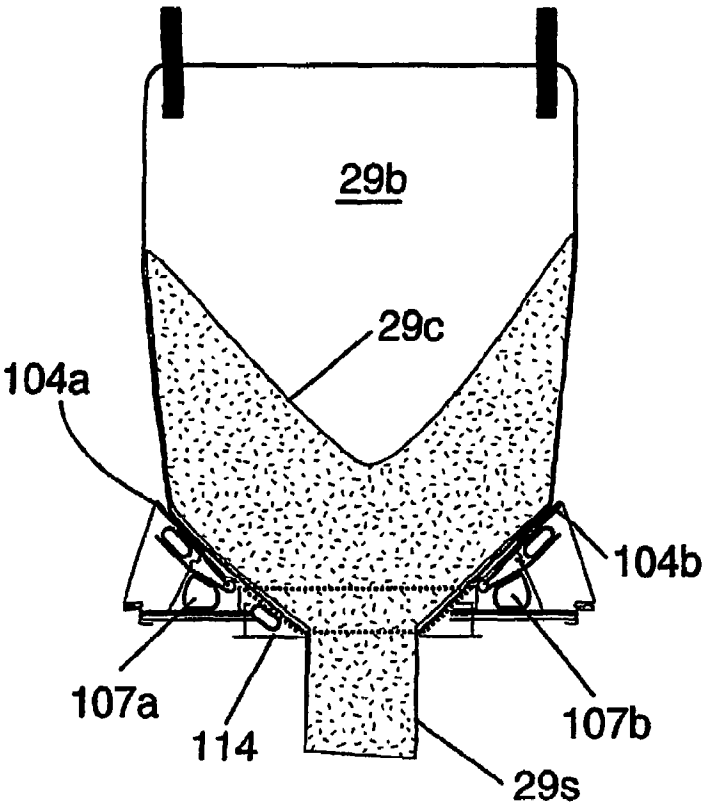
FIG. 8 is a side view of the hopper shown in FIG. 6 with a bag starting to be unloaded.

FIG. 8 is a side view of bulk bag 29*b* placed on adjustable bag hopper 114 with bottom actuators 107*a* and 107*b* inflated to raise massage paddles 104*a* and 104*b* respectively to an angle of about 45 degrees. Actuators 107*a* and 107*b* may be inflated one or more times to break up and loosen material 29*c* in bag 29*b* for agitation purposes.

Figure 9:
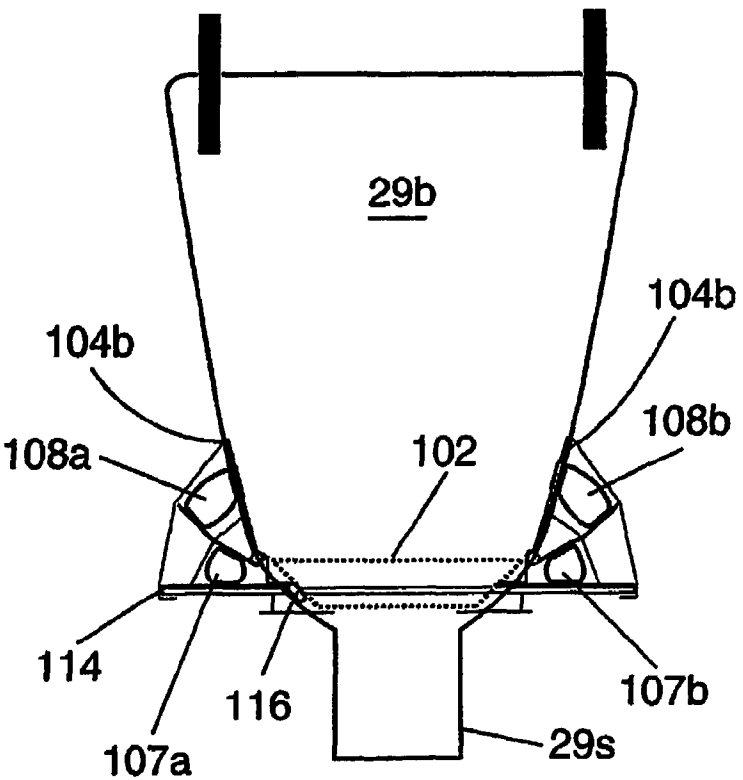
FIG. 9 is a side view of the hopper and bag shown in FIG. 8 with the bag unloaded.

FIG. 9 is a side view of adjustable bag hopper 114 with bottom actuators 107*a* and 107*b*; and top actuators 108*a* and 108*b* fully inflated to raise massage paddles 104*a* and 104*b* to an angle of approximately 80 to 90 degrees to provide complete emptying of bag 29*b*. Internal hopper ring may be used with hopper flange ring 92 with vibrator 116 to aid in material discharge of a bulk bag. Because the adjustable bag hopper 114 can perform the complete discharge function for emptying bulk bags, which includes the agitation and massage function to break up caked and compacted materials; and also the ability to completely empty a bag without stretching it, adjustable bag hopper 114 may be mounted on portable unloaders, mixers and other types of vessels and equipment that bulk bags may be emptied from for applications that have in restricted head room areas and other space constraints.

Figure 10:
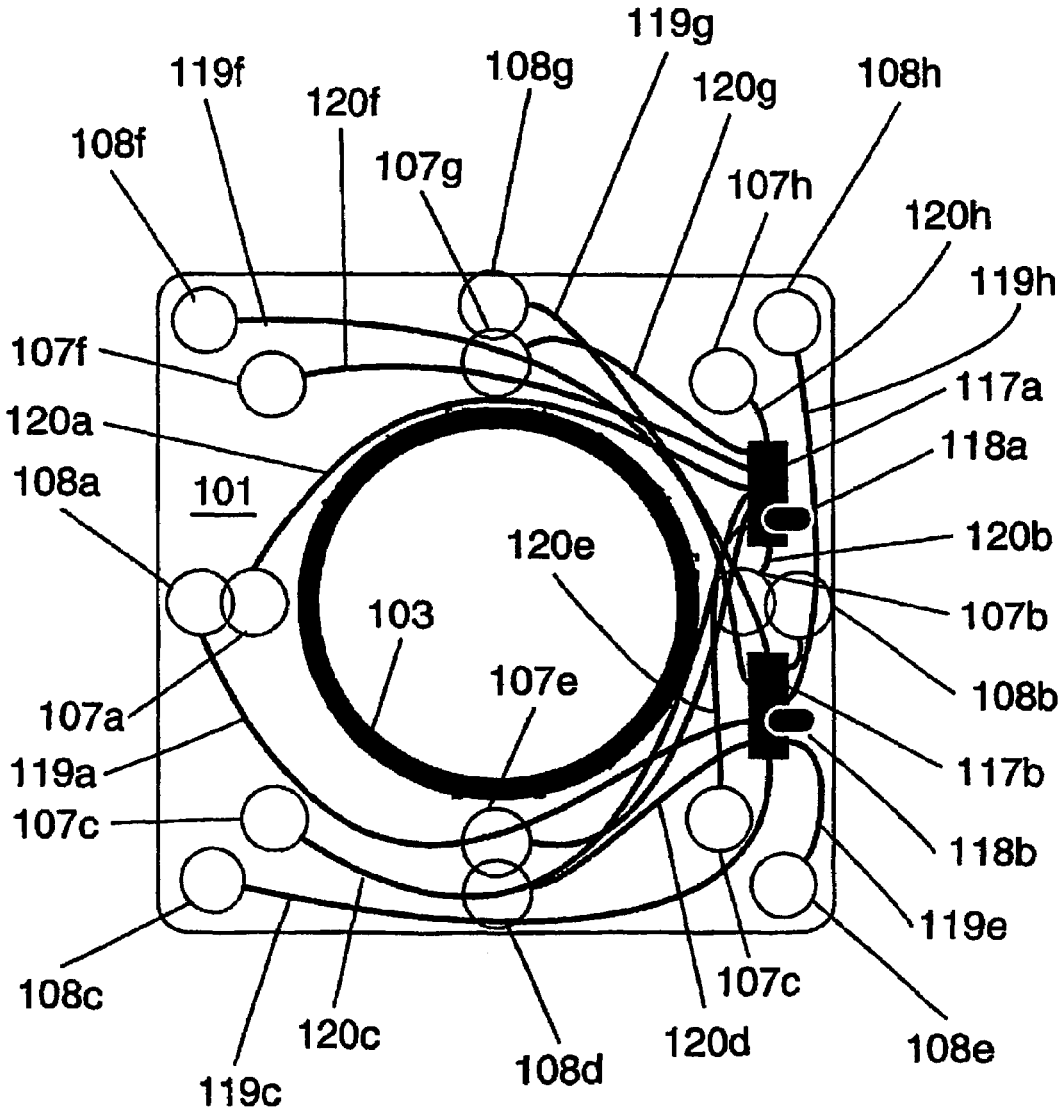
FIG. 10 is a top view of the mounting base showing a bottom actuator manifold and pressure regulator.

FIG. 10 is a top view of mounting base 101 with bottom actuator manifold 117*a* and bottom pressure regulator 118*a* assembly that supplies air to bottom actuators 107*a*, 107*b*, 107*c*, 107*d*, 107*e*, 107*f*, 107*g* and 107*h* through air lines 120*a*, 120*b*, 120*c*, 120*d*, 120*e*, 120*f*, 120*g* and 120*h* respectively. Top actuator manifold 117*b* and top pressure regulator 118*b* may supply air to top actuators 108*a*, 108*b*, 108*c*, 108*d*, 108*e*, 108*f*, 108*g* and 108*h* through air lines 119*a*, 119*b*, 119*c*, 119*d*, 119*e*, 119*f*, 119*g* and 119*h* respectively. Valves 121 (not shown) may control air-flow from compressors or other air sources to actuator manifolds 117*a* and 117*b* and pressure regulators 118*a* and 118*b* on a manual or automatic basis. Valves may be controlled by a PLC and or adjusted manually according to a particular discharge process.

Figure 11:
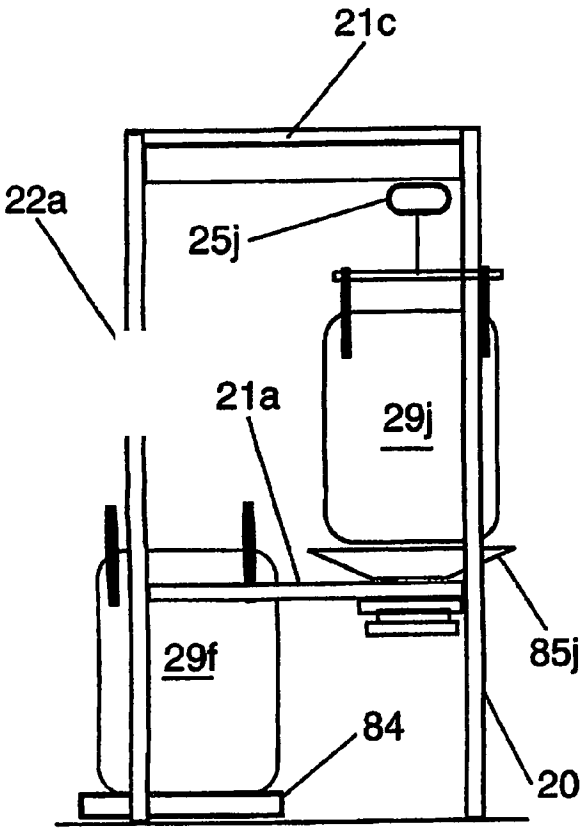
FIG. 11 is an end view of an unloader of a bag lifted over a hopper for discharge, and the vertical centers of gravity of the bags being inside the frame.

FIG. 11 is an end view of unloader 20 with bag 29*j* lifted over bag platform hopper 85*j* for discharge. Bag 29*f* on pallet 84 is placed between front posts 22*a* and 22*d* (not shown) of unloader 20 so that it is ready for placement on bag platform hopper 85*j* once bag 29*j* is emptied. The footprint of unloader 20 and bag 29*f* is typically smaller than the footprint of a cantilevered unloader (not shown) because the bag staged 29*f* is inside frame post 22*a* and 22*d* (not shown) of unloader 20. Because bag platform hopper 85*j* is off center and positioned towards the back of unloader also allows for a smaller footprint than conventional, cantilevered I-Beam unloaders.

Figure 12:
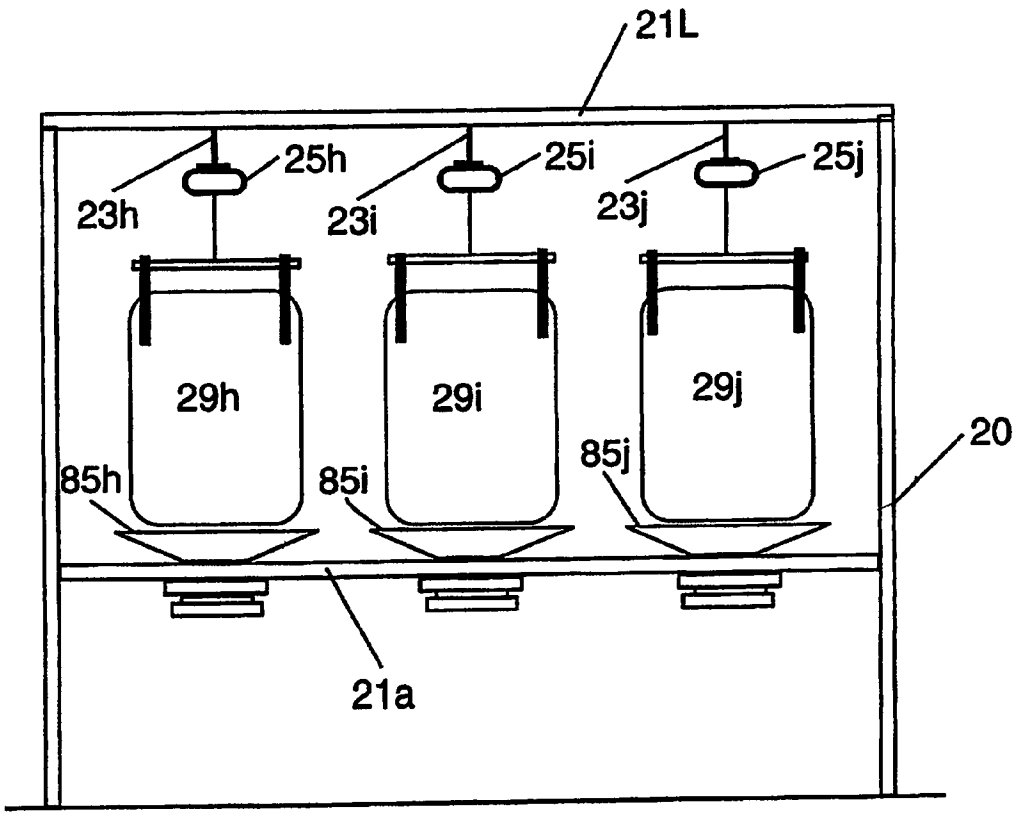
FIG. 12 is a front view of an unloader having a plurality of platform hoppers.

FIG. 12 is a front view of unloader 20 having multiple bag platform hoppers 85*h*, 85*i* and 85*j*. A single unloader 20 frame can be used to unload bags 29*h*, 29*i* and 29*j* on bag platform hoppers 85*h*, 85*i* and 85*j* respectively because the frame design does not require I-beam's 23*h*, 23*i* and 23*j* to be cantilevered. Also, because I-Beam's 23*h*, 23*i* and 23*j* are not cantilevered, unloader frame 20 does not require cross bracing supports as conventional cantilevered frames. Unloader 20 provides a single frame for multiple bag discharge locations that allows costs to be lower and smaller space requirements.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

I claim:

1. A bulk bag unloader comprising
at least one bottom frame,
unloader frame brackets secured to the bottom frame,
an adjustable frame constructed without cross bracing,
a top frame secured to the adjustable frame,
an I-beam secured horizontally to the middle of the top frame, said I-beam being substantially the same length as the adjustable frame is wide,
a trolley for moving a hoist along the I-beam within the top frame:
a hoist coupled with the trolley for lifting a bulk bag up and down; and
a bag support hopper supported by the unloader brackets.

2. The unloader of claim 1, further comprising a bag tray adapted to support a bulk bag and secured in a sraced, off-center relationship to the frame such that the hoist positioned over a bulk bag's center of gravity can lift a bulk bag from the ground, move it along the I-beam, and position it on the bag tray.

3. The unloader of claim 1, wherein the frame is sized such that the vertical centers of gravity of two horizontally adjacent bulk bags can be inside the frame.

4. The unloader of claim 1, the hopper comprising hopper brackets adapted to support the hopper by the unloader frame brackets, and further comprising at least one load cell disposed between the hopper brackets and unloader frame brackets.

5. The unloader of claim 1, further comprising at least one vibration isolator disposed between the hopper brackets and unloader frame brackets.

6. The unloader of claim 5, further comprising a vibration flange secured to the hopper.

7. The unloader of claim 1, further comprising a hopper flange ring secured to said hopper.

8. The unloader of claim 7, further comprising a discharge device plate secured to said hopper flange ring.

9. The unloader of claim 8, further comprising a discharge device removably secured to said discharge device plate.

10. The unloader of claim 1, further comprising a swiveled seat mounted to an unloader adjustable frame.

11. A bulk bag unloader comprising
at least one bottom frame,
a plurality of unloader frame brackets secured to the bottom frame,
a bag support hopper supported by the unloader brackets,
an adjustable frame constructed without cross bracing,
a top frame secured to the adjustable frame,
an I-beam secured horizontally to the middle of the top frame, said I-beam being substantially the same length as the adjustable frame is wide,
a trolley for moving a hoist and bulk bag along the I-beam within the top frame,
a hoist coupled with the trolley for lifting a bulk bag up and down, and
a seat mounted to the unloader.

* * * * *